US005873474A

United States Patent [19]

Gray

[11] Patent Number: 5,873,474

[45] Date of Patent: Feb. 23, 1999

[54] EZ BABY BOTTLE STRAW

[76] Inventor: Lisabeth E. Gray, 7429 McWhorter Pl., Annadale, Va. 22003

[21] Appl. No.: 873,163

[22] Filed: Jun. 11, 1997

[51] Int. Cl.[6] ..... A61J 9/00

[52] U.S. Cl. ..... 215/11.1; 215/11.4; 222/464.4

[58] Field of Search ..... 606/234–236; 215/11.1, 11.4, 11.5, 11.6; 222/464.4

[56] References Cited

U.S. PATENT DOCUMENTS

| | | | |
|---|---|---|---|
| 2,868,203 | 1/1959 | Tichy | 215/11.4 |
| 3,346,133 | 10/1967 | Herdman | 215/11.1 |
| 3,547,296 | 12/1970 | Greenberg | 215/11.4 |
| 4,754,887 | 7/1988 | Ou | 215/11.4 |
| 4,940,152 | 7/1990 | Lin | 215/11.5 |
| 4,969,564 | 11/1990 | Cohen et al. | 215/11.4 |
| 4,994,076 | 2/1991 | Guss | 215/11.4 |

*Primary Examiner*—Michael Buiz
*Assistant Examiner*—David O. Reip
*Attorney, Agent, or Firm*—Patent & Trademark Services; Joseph H. McGlynn

[57] ABSTRACT

A nursing bottle device which comprises a one piece cap that will attach to a baby bottle and has few parts so it can be sterilized. The cap has an up right portion and a straw that extends into the bottle which will prevent air from entering the nipple as the baby nurses. In addition, there is a weighted ball at the end of the tube to allow the tube to follow the liquid in the bottle.

4 Claims, 1 Drawing Sheet

EZ BABY BOTTLE STRAW

BACKGROUND OF THE INVENTION

This invention relates, in general, to infant nursing devices, and, in particular, to a bottle top and straw which can be used in any baby bottle.

DESCRIPTION OF THE PRIOR ART

In the prior art various types of nursing devices. For example, U.S. Pat. No. 4,994,076 discloses a device for a baby bottle which has a nipple attached to a flexible tube. The other end of the flexible tube is attached to a baby bottle and there is a clip to anchor the tube.

U.S. Pat. No. 4,969,564 discloses a baby bottle having a nipple connected to a tube which extends into the baby bottle.

U.S. Pat. No. 4,754,887 discloses a nursing bottle having a tube that extends into a nursing bottle and which has a plate attached thereto with a one way valve.

U.S. Pat. No. 3,547,296 discloses a tube for a nursing bottle with a weighted base member secured to the free end of the tube. A spring coil wound around the tube prevents the weight from pinching the tube.

While the prior art devices perform their intended functions, there is a need for a device which is a simple structure that is easy to sterilize and to use. Also, there is a need for a device which is simple to assemble on a baby bottle and will fit all standard bottles.

SUMMARY OF THE INVENTION

The present invention comprises a nursing bottle device which comprises a one piece cap that will be used in a baby bottle and has few parts so it can be sterilized. The cap has an up right portion which is held in place when the nipple and ring assembly is screwed onto the bottle, and a straw that extends into the bottle which will prevent air from entering the nipple as the baby nurses. In addition, there is a weighted ball at the end of the tube to allow the tube to follow the liquid in the bottle.

It is an object of the present invention to provide a nursing bottle device which is simple and easy to manufacture.

It is an object of the present invention to provide a nursing bottle device which is easy to sterilize.

It is an object of the present invention to provide a nursing bottle device which will fit all standard nursing bottles and which can also be produced in a disposable option as well.

These and other objects and advantages of the present invention will be fully apparent from the following description, when taken in connection with the annexed drawings.

DESCRIPTION OF THE PREFERRED EMBODIMENT

Figure 1:
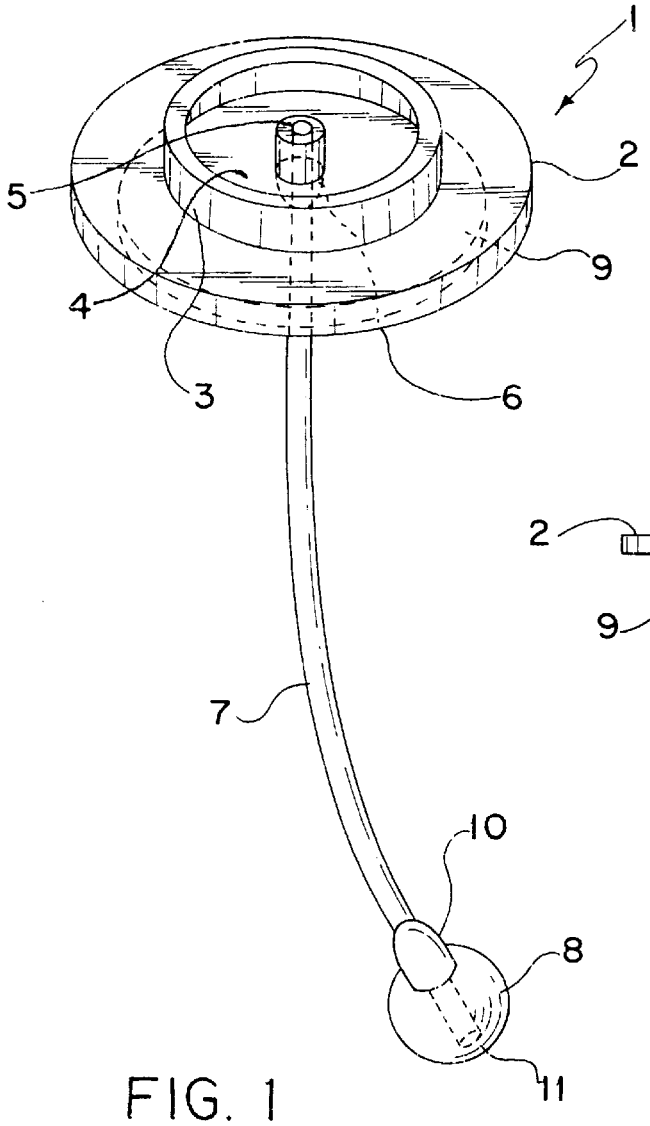
FIG. 1 is a perspective view of the present invention.
Figure 2:
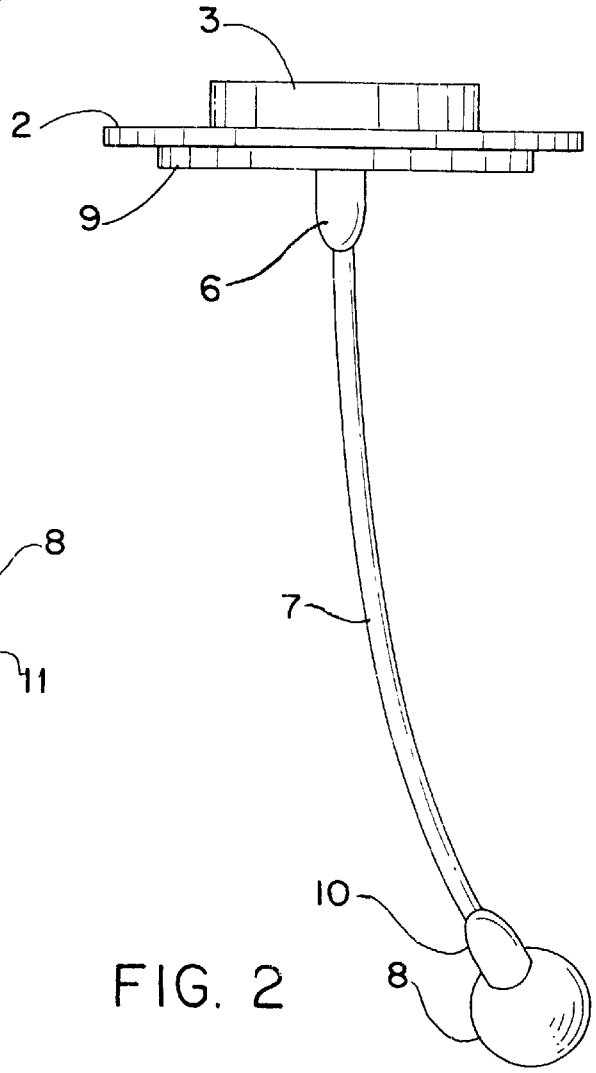
FIG. 2 is a side view of the present invention.

Referring now to the drawings in greater detail, FIG. 1 shows the cap 1 of the present invention which will be used in a standard nursing bottle (not shown). The cap has an upright, cylindrical wall 3 which is coaxially secured in approximately the center of the cap. The straw 7 is placed into the baby bottle and the flange 2 rests on the mouth of the bottle. The mouth of the bottle is slightly smaller than the flange portion 2 so the disk will rest on top of the bottle and will not fall in. The nipple, that comes with the baby bottle will fit into the threaded ring that also comes with the bottle. The nipple and threaded ring assembly will fit over the top of the wall 3 and will be threadedly attached to the baby bottle. The nipple will not be attached to the straw assembly except by the attachment of the threaded ring with the baby bottle.

Attached at the bottom of the wall 3 is a planar, upper portion 4 of the end. The portion 4 should be co-planer with the floor of the wall 3 to present a smooth, planar floor at the bottom of the wall 3. Within the portion 4 is an aperture which connects with the straw 7 to allow milk, or some other fluid within the baby bottle to be drawn up when the infant is nursing.

The enlarged portion 6 makes it easier to attach the tube or straw 7 to the floor within the wall 3, for reasons which will be explained below.

Surrounding the wall 3 is a flange 2 which will rest on the top of the baby bottle when the nursing device 1 is attached to a bottle. Beneath the flange 2 is a second and smaller flange 9 which will fit within the mouth of a baby bottle in order to secure the device 1 to a baby bottle.

A flexible straw or tube 7 is attached to the enlarged portion 6 at one end. The straw or tube will pass completely through the enlarged portion and will end in an opening 5 within the wall 3. This will allow a baby to draw milk or some other liquid through the straw 7 into the nipple that is attached to the wall 3.

At the opposite end of the straw is a second enlargement 10 which will be attached to a ball or other spherical object 8. The ball should be weighted so the end of the straw which is immersed in the liquid in the baby bottle will remain within the liquid in the bottle if the infant tilts the bottle to one side. This will prevent air from entering the straw 7 and will also make it easier for the infant to withdraw the liquid from the bottle since the end of the straw 7 will remain within the liquid in the bottle. The ball 8 should be made from a material that is heavier than the liquid in the bottle, such as milk, juice, water, or formula. This will cause the ball to sink in the liquid and maintain the end 11 of the straw within the liquid. As with the top of the straw, the bottom of the straw will pass through the ball 8 so that liquid will be drawn through the straw.

The entire device 1 could be made by molding it in one piece. Another method of manufacture could be to make the various elements in pieces. For example, the wall 3, and the flanges 2, 9 could be made as one piece and the straw 7 with the enlargements 6, 10 could be made as another piece, and the weighted ball 8 could be made as a third piece. Then the various pieces could be secured by ultrasonic welding. In using this second technique, the enlargements 6, 10 provide a greater surface area adjacent the parts they will be secured to (i.e. the floor within wall 3 and the ball 8. This greater area will make the ultrasonic joint more secure.

Although the EZ baby Bottle Straw and the method of using the same according to the present invention has been described in the foregoing specification with considerable details, it is to be understood that modifications may be made to the invention which do not exceed the scope of the appended claims, for example, the invention could be produced in a disposable form if desired. Modified forms of the present invention done by others skilled in the art to which the invention pertains will be considered infringements of this invention when those modified forms fall within the claimed scope of this invention.

What I claim as my invention is:

1. A device adapted to be attached to a baby bottle to allow an infant to ingest the contents of the bottle, comprising:

a first end having a cylindrical wall, said cylindrical wall having a floor with an aperture therein, a second cylindrical wall extending below said floor for engaging an inside surface of a mouth of a baby bottle, a hollow tube having one end connected to said floor and a second end having a weighted spherical member attached thereto, said hollow tube having enlargements at each end, one enlargement attached to said floor and another enlargement attached to said weighted spherical member.

2. The device adapted to be attached to a baby bottle as claimed in claim 1, wherein said device is a unitary device.

3. The device adapted to be attached to a baby bottle as claimed in claim 1, wherein said device is composed of constituent parts which are ultrasonically welded together.

4. The device adapted to be attached to a baby bottle as claimed in claim 1, wherein said device is disposable.

* * * * *